US005195791A

United States Patent [19]

Hu

[11] Patent Number: 5,195,791

[45] Date of Patent: Mar. 23, 1993

[54] PORTABLE SECURITY BUCKLE FOR DOORS

[76] Inventor: Chiu S. Hu, No. 217, Kae Hsuan Rd., Feng Shan City, Kao Hsiung Hsien, Taiwan

[21] Appl. No.: 929,666

[22] Filed: Aug. 13, 1992

[51] Int. Cl.[5] ..... E05C 17/54

[52] U.S. Cl. ..... 292/298; 292/246

[58] Field of Search ..... 292/298, 289, 319, 292, 292/263, 323, 295, 246

[56] References Cited

U.S. PATENT DOCUMENTS 1,498,681 6/1924 Cormier ..... 292/298

2,396,982 3/1946 Bosquet ..... 292/289

3,770,307 11/1973 Van Gompel ..... 292/307 R 4,155,578 5/1979 Rolland ..... 292/292

4,382,621 5/1983 Lum ..... 292/298 X

*Primary Examiner*—Richard E. Moore

*Attorney, Agent, or Firm*—Perman & Green

[57] ABSTRACT

A portable security buckle. The portable security buckle has a tongue which is inserted in a recess in a jamb of a door frame, together with a lock tongue. A fastening assembly is used to retain the tongue and a door in position. Thus, the door can not be opened unless the fastening assembly is released.

3 Claims, 3 Drawing Sheets

PORTABLE SECURITY BUCKLE FOR DOORS

BACKGROUND OF THE INVENTION

The present invention relates to a portable security buckle adapted for restraining a door from being opened by an intruder.

People often frequent hotels when traveling away from home. A door in a hotel room is always equipped with a lock used for restraining the door from being opened whether an occupant is in the hotel room or not. It is desirable that the door is securely locked particularly when the occupant sleeps in the hotel room. However, such a lock can be easily picked. To solve this problem, a chain lock is used for restraining such a door from being opened by an intruder even if the lock is picked. However, due to the nature of the chain lock, the door can be opened to such an extent that cutters can be inserted past the door in order to cut the chain lock. Thus, the door is opened by an intruder. Therefore, the present invention is intended to solve the above-mentioned problem.

SUMMARY OF THE INVENTION

It is an object of the present invention to provide a portable security buckle having (A) a tongue insertable in a recess in a jamb of a door frame together with a lock tongue and (B) a fastening assembly for retaining the tongue and a door in position so that the door can not be opened unless the fastening assembly is released.

For a better understanding of the present invention and objects thereof, a study of the detailed description of the embodiments described hereinafter should be made in relation to the accompanying drawings.

DETAILED DESCRIPTION OF THE PREFERRED EMBODIMENT

Figure 1:
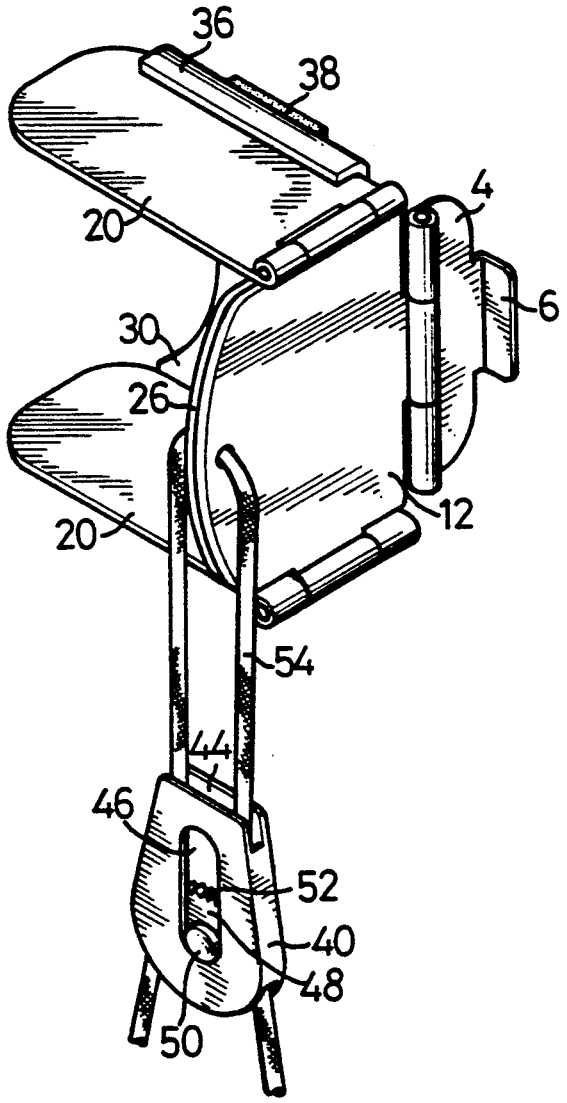
FIG. 1 a perspective view of a portable security buckle in accordance with the present invention.

Referring to the drawings and, more particularly, to FIG. 1, a portable security buckle 2 is shown in a perspective view.

Figure 2:
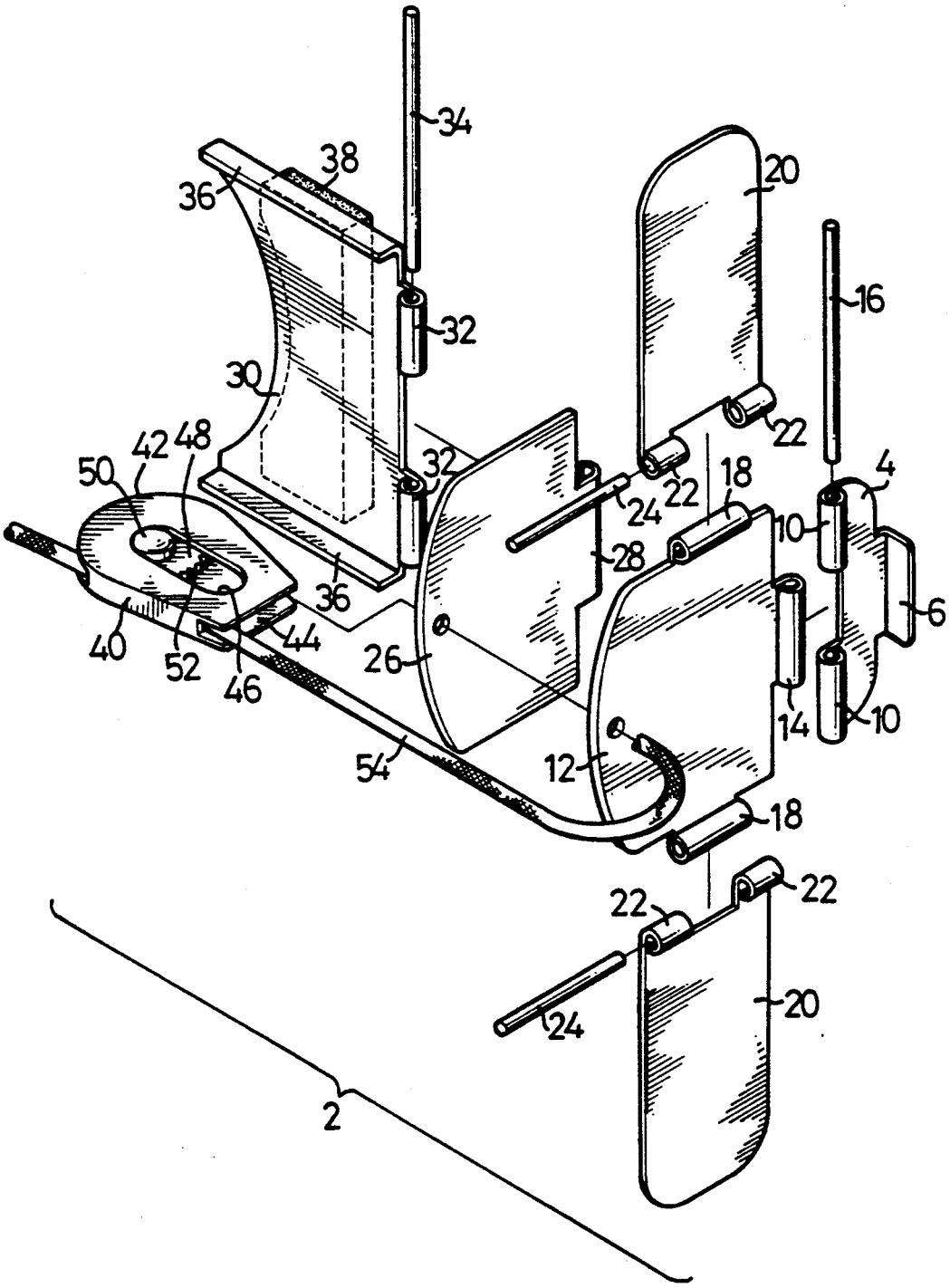
FIG. 2 is an exploded view of a portable security buckle in accordance with the present invention.

Referring to FIG. 2, the portable security buckle 2 has a hooking strip 4. The hooking strip 4 has a tongue 6 extending therefrom at right angles. Two tubular portions 10 are formed along an edge opposite to the edge from which the tongue 6 extends.

A plate 12 has a tubular portion 14 along an edge. The tubular portion 14 is disposed between and aligned with the tubular portions 10. A pin 16 is inserted through the tubular portions 10 and 14. Thus, the hooking strip 4 is pivotally attached to the plate 12. Two tubular portions 18 are respectively formed along two edges beside the edge along which the tubular portion 14 is formed. Two lateral plates 20 each have two tubular portions 22. Each tubular portion 18 is disposed between and aligned with the tubular portions 22 of a corresponding lateral plate 20. Two pins 24 are respectively inserted through the tubular portions of a corresponding lateral plate 20 and a corresponding tubular portion 18. Thus, the lateral plates 20 are pivotally attached to the plate 16.

A plate 26 has a tubular portion 28 along an edge. The plate 26 is securely attached to the plate 16 by means of an adhesive or other appropriate means. A plate 30 has two tubular portions 32 along an edge. The tubular portion 28 is disposed between and aligned with the tubular portions 32. A pin 34 is inserted through the tubular portions 32 and 28. Thus, the plate 30 is pivotally attached to the plate 26. An edge which is opposite to the edge along which the tubular portions 32 are formed is shaped as a concave arc. Two margins 36 beside the arc-shaped edge are bent. A rubber pad 38 or the like is securely attached to the plate 30 by means of an adhesive or other appropriate means.

A fastening assembly has a casing 40 having two plates parallel to each other. Each plate is shaped as a semi-circular portion joining an isosceles trapezoidal portion tapered away from the semi-circular portion. Two walls integrally extend along the sides of the isosceles trapezoidal portions of the plates of the casing 40. Thus, an opening 42 is defined along the semi-circular edges of the plates of the casing 40 and an opening 44 is defined along the bottom edges of the isosceles trapezoidal portions of the plates of the casing 40. The first plate of the casing 40 has a slot 46.

A disk 48 has a protrusion 50 extending from its center. The disk 48 is disposed in the casing 40 with the protrusion 50 slidably received in the slot 46. The disk 48 has serrations 52 along its perimeter.

A rope 54 is inserted through holes in the plates 12 and 26. The ends of the rope 54 are respectively inserted through (A) the openings 44, (B) the paths between the walls of the casing 40 and the serrated perimeter of the disk 48 and (C) the opening 42.

Figure 3:
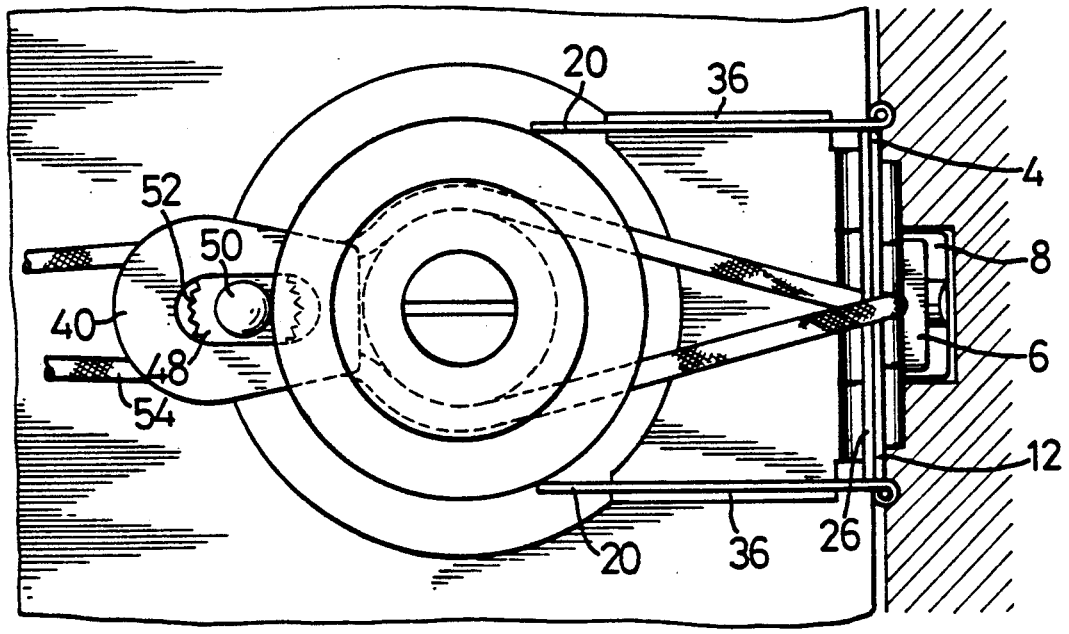
FIG. 3 is a side view of a portable security buckle locking a door in accordance with the present invention.

Referring to FIG. 3, the tongue 6 is inserted in a recess in a jamb of a door frame, together with the lock tongue 8. The hooking strip 4 is disposed between the jamb and an edge of a door. The plates 12 and 26 are disposed perpendicular to the door. The lateral plates 20 are disposed between and against the bent margins 36. The pad 38 is disposed between the door and the plate 30.

The rope 54 is around a door knob and tightened. Then, the disk 48 is urged toward the opening 44 along the slot 46 as far as possible. The serrations 52 compress the rope 54 against the walls of the casing 40. When the rope 54 is pulled in a direction from the opening 42 toward the opening 44, normal forces respectively on interfaces of the rope 54 and the walls of the casing 40 and interfaces of the rope 54 and the serrations 52 increase, as the casing 40 is tapered along the same direction. That is, frictional forces respectively on interfaces of the rope 54 and the walls of the casing 40 and interfaces of the rope 54 and the serrations 52 increase. Consequentially, the rope 54 is restrained from being further pulled.

The door cannot be opened unless the rope 54 is loosened. That is, the disk 48 must be moved toward the opening 42 in order to release the rope 54.

While the present invention has been explained in relation to its preferred embodiment, it is to be understood that variations thereof will be apparent to those skilled in the art upon reading this specification. Therefore, the present invention is intended to cover all such variations as shall fall within the scope of the appended claims.

I claim:

1. A portable security buckle comprising:

a hooking strip from which a tongue extends for being inserted in a recess in a jamb of a door frame;

a first plate being pivotally connected with said hooking strip and having a working position parallel to said hooking strip;

two lateral plates being pivotally connected with said first plate beside said hooking strip and having a working position perpendicular to said first plate;

a second plate securely attached to said first plate;

a third plate pivotally connected with said second plate for restraining said lateral plates when disposed in a working position perpendicular to said first and second plates;

a rope being securely attached to said first and second plates and having two terminal sections for being disposed around a door knob; and means for fastening said rope.

2. A portable security buckle in accordance with claim 1, wherein said means for fastening said rope comprises:

a casing having (A) two plates each having a semi-circular portion and an isosceles trapezoidal portion and (B) two walls extending along the sides of said isosceles trapezoidal portions of said plates; and a disk having a serrated perimeter defining two paths respectively with said walls, said terminal sections of said rope are inserted through said paths; said disk having a releasing position where said serrated perimeter does not compress said terminal sections against said walls and a fastening position where said serrated perimeter compresses said terminal sections against said walls when said rope is loaded with tension.

3. A portable security buckle in accordance with claim 2, wherein one of said plates of said casing has a slot and said disk has a transverse protrusion received in said slot.

* * * * *